United States Patent [19]

Hugin

[11] 4,013,329

[45] Mar. 22, 1977

[54] MULTIPLE PLATE ASSEMBLY FOR FORMING ELECTRICAL CONNECTOR OR SWITCH

[75] Inventor: Peter E. Hugin, Los Altos, Calif.

[73] Assignee: Multilam Corporation, Los Altos, Calif.

[22] Filed: Feb. 23, 1976

[21] Appl. No.: 660,549

[52] U.S. Cl. ..... 339/9 E; 339/95 D; 339/150 R

[51] Int. Cl.[2] ..... H01R 41/00

[58] Field of Search ..... 339/9 E, 95 R, 95 D, 339/91, 101, 103 R, 103 B, 103 M, 106, 107, 74 R, 111, 49 R, 61 M, 126 R, 205, 256 R, 150 R, 253 R

[56] References Cited

UNITED STATES PATENTS

| | | | |
|---|---|---|---|
| 1,901,894 | 3/1933 | Burke | 339/150 R |
| 2,217,433 | 10/1940 | Crabbs | 339/253 R |
| 2,280,728 | 4/1942 | Streib | 339/256 R |
| 2,380,916 | 8/1945 | Beal | 339/205 |
| 3,161,451 | 12/1964 | Neidecker | 339/91 |
| 3,218,606 | 11/1965 | Schultz | 339/256 R |
| 3,275,967 | 9/1966 | Hamm | 339/61 M |
| 3,453,587 | 7/1969 | Neidecker | 339/256 R |
| 3,622,940 | 11/1971 | Illies | 339/94 M |
| 3,660,802 | 5/1972 | Staudt | 339/126 R |
| 3,845,451 | 10/1974 | Neidecker | 339/49 R |
| 3,861,595 | 1/1975 | Deal | 339/95 R |
| 3,861,776 | 1/1975 | Deal | 339/74 R |
| 3,930,709 | 1/1976 | Stanger et al. | 339/111 |

FOREIGN PATENTS OR APPLICATIONS

| | | |
|---|---|---|
| 1,207,193 | 2/1960 | France |
| 1,106,390 | 5/1961 | Germany |

*Primary Examiner*—Roy Lake
*Assistant Examiner*—DeWalden W. Jones
*Attorney, Agent, or Firm*—Townsend & Townsend

[57] ABSTRACT

Apparatus defining an electrical connection capable of carrying relatively high electrical currents including a number of heavy-duty electrical conductors normally spaced apart and electrically interconnected by an improved connector unit having a plurality of spaced, stacked plates having louvered electrical connector devices. Each plate has a pair of opposed faces with each face having one or more grooves therein. Each groove is provided with one of the louvered electrical connector devices. Each such device has a plurality of spaced, electrically conducting, resiliently mounted fins whose curved outer edges are adapted to engage the corresponding plate and to make electrical contact with the adjacent electrical conductor. A number of embodiments of the apparatus are disclosed.

12 Claims, 14 Drawing Figures

FIG. 8
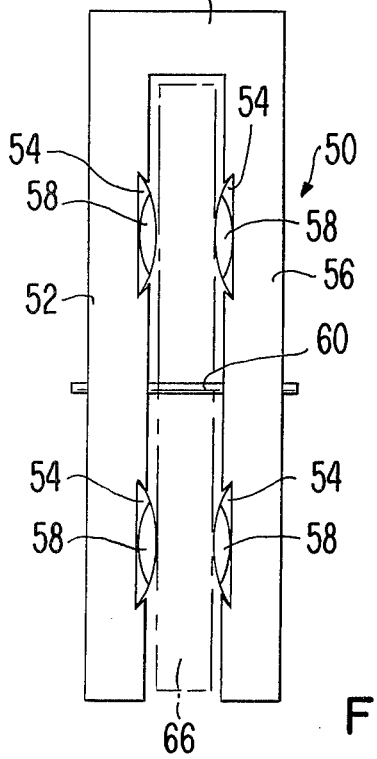
FIG. 9
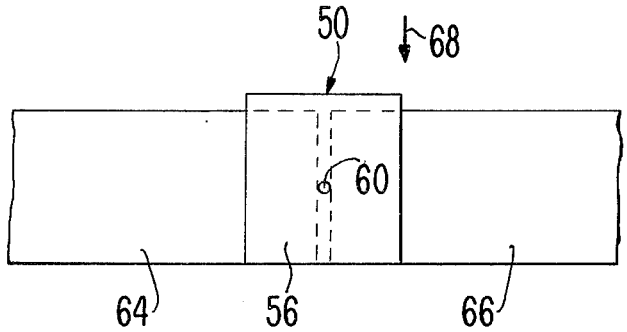
FIG. 10
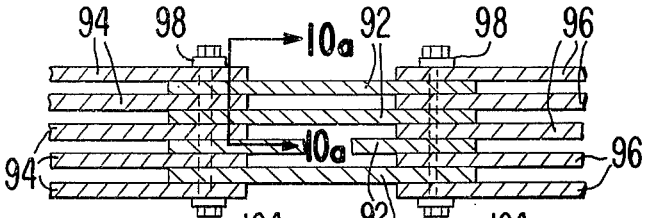
FIG. 10a
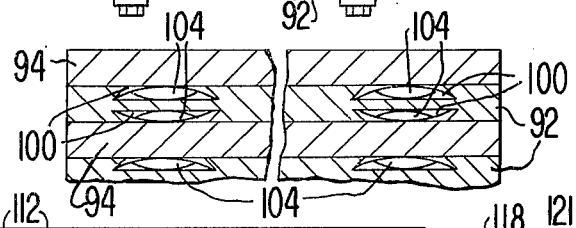
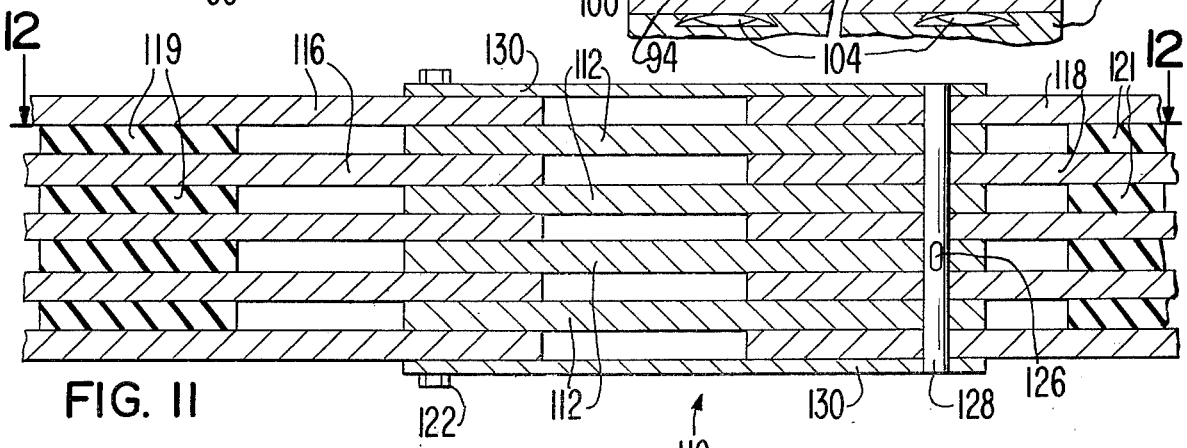
FIG. 11
FIG. 12
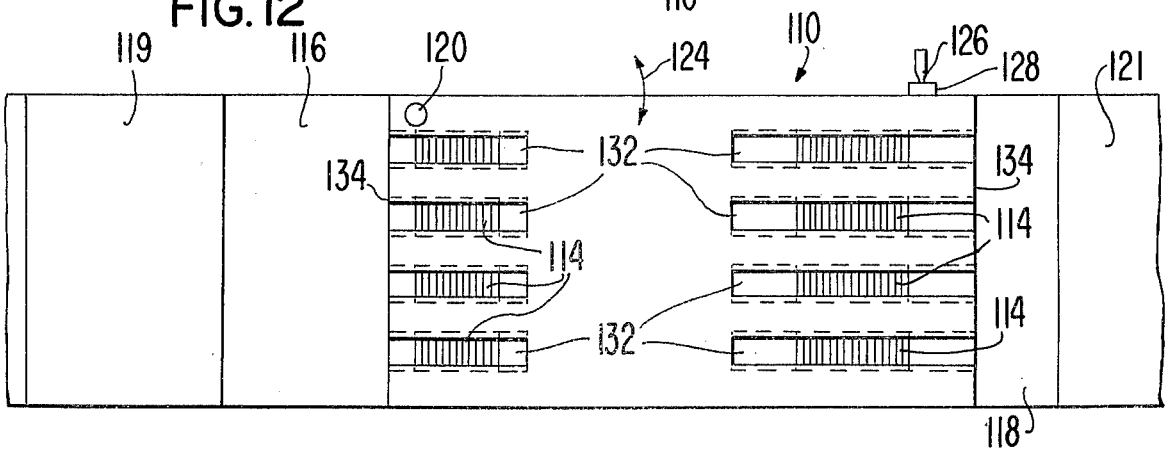

MULTIPLE PLATE ASSEMBLY FOR FORMING ELECTRICAL CONNECTOR OR SWITCH

This invention relates to improvements in electrical connectors for heavy-duty electrical equipment and, more particularly, to an electrical connector assembly having a multiple plate electrical connector unit.

BACKGROUND OF THE INVENTION

In the transfer of electrical power from one group of conductors to another group, such as by switches, permanent electrical connectors and the like, it has been the practice to utilize connector plates or bus bars of low impedance and relatively large surface area to provide the desired electrical contact between conductors. This generally requires that the conductors and the connector plates have opposed surfaces which are substantially flat throughout their entire area to assure positive electrical contact over at least part of these areas to minimize electrical losses. Since the surfaces are never completely flat, The surfaces present a relatively small number of randomly located point contacts and, as a result, the quality of the electrical connection is not as high as it should be to minimize the losses mentioned above. Moreover, the face-to-face contact between heavy-duty electrical conductors and bridging parts requires considerable pressure to keep the contact surfaces in proper engagement with each other, and it is not possible to maintain these pressures over time. These pressures, especially if there is to be relative movement periodically between the elements forming a connection, such as in a switch or in plug-in devices, are the cause of considerable design and maintenance problems.

Due to the size of the conductors, it is usually necessary to provide an expansion joint capability because of temperature cycling. In conventional joints, these are made from braid or thin sheet assemblies. Thus, any improvements in electrical connectors for conductors of this type requires that this capability be taken into consideration.

A need has, therefore, arisen for improvements in releasable electrical connectors of the type having a number of heavy-duty conductors to be interconnected so as to transfer electrical power from one group of conductors to another group. The need is based upon a high quality connection having low energy losses and a requirement that this connection be easily assembled and disassembled, that the pressure required for assembly will not place high stresses on the fastener means, and that the connection maintain its electrical quality over long time periods, thereby reducing maintenance cost and cost of production.

SUMMARY OF THE INVENTION

The present invention satisfies the aforesaid need by providing an electrical connector assembly of the type associated with a number of heavy-duty electrical conductors arranged to be electrically interconnected either as a bolt-free, bolted or clamped assembly or as a sliding or rotating assembly. To this end, the invention includes an improved electrical connector unit having a plurality of spaced, stacked plates for use as bridging elements between groups of electrical conductors. The plates are arranged so that the connector unit itself can be readily put in an operative position bridging the gap between one or more groups of conductors of heavy-duty construction, yet the overall assembly is relatively simple in construction and will reduce the overall installed cost.

Each plate of the connector unit of this assembly is provided with a pair of opposed faces, at least one of which has one or more grooves therein. A louvered electrical connector device is provided for each groove, respectively, with each device having a plurality of angled, electrically conducting fins resiliently mounted and provided with curved outer, opposed edges so that, when the fins engage an adjacent plate and the corresponding conductor, the plate and conductor will be positively electrically interconnected and will remain so as long as the connector unit is in its operative position.

The fins on each electrical connector device assure optimum power transfer between the conductor and the corresponding plate because the curved outer edges of each fin make substantially a line contact and thereby create a much larger contact area than the relatively small number of random point contacts of conventional connections. Thus, energy losses at the junctions between the conductors and the plates of the connector unit of this assembly are usually substantially reduced. Moreover, the fins will maintain the original quality of the joint for a long time because the fins are spring-loaded and, when temperature cycling occurs, the fins will rotate about their longitudinal axes and thereby perform a wiping action on both contact surfaces.

Another advantage of the use of the present invention is the savings in metal costs that can be realized because, with plates having louvered electrical contact devices, a smaller overlap between the plate and the conductor can be used than is the case with conventional joints. Typically, a 4-inch overlap is all that is needed for a 1-inch by 10-inch bus; this is in contrast with a 10-inch overlap required with conventional joints. Also, smaller and cheaper bolts can be used because of the relatively small pressures involved and because the bolts do not need to be current carriers.

The primary object of this invention is, therefore, to provide an improved electrical connector assembly of the type associated with one or more groups of electrical conductors of heavy-duty construction to be electrically interconnected wherein the assembly includes an electrical connector unit of multiple plate construction with one or more faces of each of the plates being provided with a groove or grooves containing louvered electrical connector devices so that the fins of the devices will be the bridging elements between respective plates and conductors to eliminate the need for high pressure surface-to-surface contact therebetween as is required in conventional connector equipment.

Another object of this invention is to provide an assembly of the type described wherein the connector unit can be of any one of a number of different configurations to suit the requirements of a specific electrical connection, all of which can be accomplished without sacrificing the quality of the connection and without substantially increasing production and maintenance costs compared with conventional bolted assemblies.

Other objects of this invention will become apparent as the following specification progresses, reference being had to the accompanying drawings for several embodiments of the invention.

In the drawings:

FIG. 1 is a perspective view of one embodiment of an electrical connector and expansion assembly having a connector unit with louvered devices engaging two electrical conductors;

FIG. 1*a* is an enlarged fragmentary top plan view of the assembly of FIG. 1;

FIG. 8 is an end elevational view of a transversely U-shaped, bolt-free connector assembly showing grooves for louvered devices extending transversely of the grooves of the connector of FIG. 1;

FIG. 9 is a side elevational view of the connector of FIG. 8, showing an assembly with two electrical conductors;

FIG. 10 is a vertical section through an assembly of stacked, spaced connector plates clamped together and having grooved sides for receiving louvered devices and for bridging stacked, spaced conductors, such assembly eliminating the need for drilling of buses;

FIG. 10*a* is an enlarged, crosssectional view taken along line 10*a*—10*a* of FIG. 10;

FIG. 11 is a view similar to FIG. 10 but showing the way in which the connector plates can be mounted to swing out of bridging relationship to respective conductors to thereby form a multi-bladed knife switch; and FIG. 12 is a view looking in the direction of line 12—12 of FIG. 11.

Figure 1:
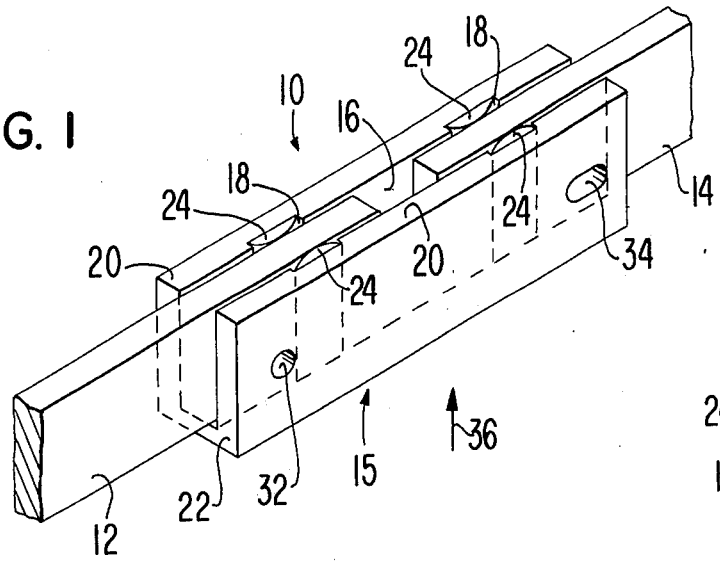
Figure 1A:
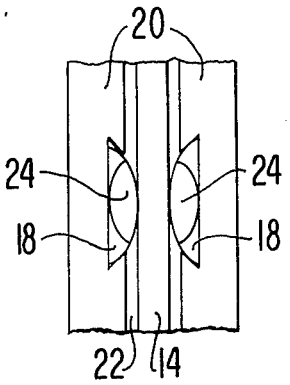

A first embodiment of the electrical connector assembly of the present invention is shown in FIG. 1 and is denoted by the numeral 10. Assembly 10 includes a pair of spaced, longitudinally aligned electrical conductors or bus bars 12 and 14 of heavy-duty construction and a transversely U-shaped, electrically conductive connector unit 15 having a length greater than the normal spacing between conductors 12 and 14. Unit 15 has a pair of spaced, opposed inner side surfaces 16 with each surface having a pair of grooves 18 extending from the outer end face 20 thereof toward the bight 22 of unit 15. The length of each groove 18 can be such that it terminates at or is slightly spaced from bight 22. The sides of each groove 18 are angled inwardly as shown in FIG. 1*a* to receive the opposed sides of a respective louvered connector device 24 (FIG. 5) having angled fins for engaging the adjacent side of a conductor 12 or 14 when connector unit 15 interconnects the conductors.

Figure 5:
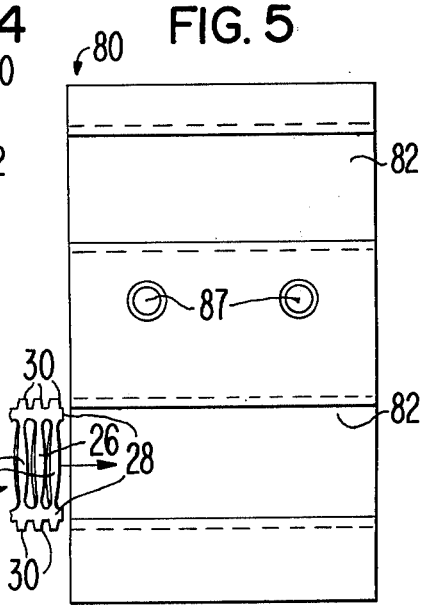
Figure 6:
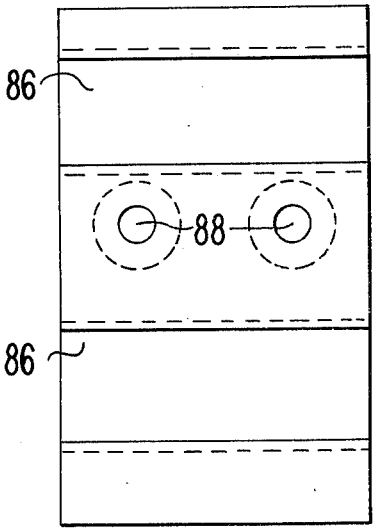
FIGS. 6 and 7 are views similar to FIGS. 5 and 4, respectively, but showing grooves on the opposite side of the connector.
Figure 7:
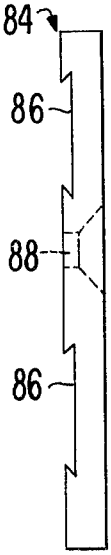

Each louvered device 24 (FIG. 5) is of the type disclosed in U.S. Pat. No. 3,453,587. Such a louvered device includes a number of angled fins 26 spanning the distance between a pair of spaced side members 28 having spaced side teeth 30 thereon which extend into the beveled side portions of the respective groove of connector unit 15. When device 24 is so mounted, its fins 26, having curved outer edges as shown in FIG. 5, bridge the distance between and engage connector unit 15 and the adjacent conductor 12 or 14. In this way, electrical connection is appropriately made and connectors 12 and 14 are effectively electrically interconnected. Since there are a plurality of fins 26 on each device 24, proper electrical contact is assured at all times notwithstanding the relatively small size of the fins.

Unit 15 may be provided with a fastener for interconnecting the same to conductors 12 and 14. For purposes of illustration, the sides of connector unit 15 can have aligned holes 32 therein, alignable with a corresponding hole in conductor 12 for receiving a bolt or other fastener. Similarly, adjacent to the other end of connector 15, the latter can have an elongated pair of elliptical holes 34 for the same purpose as hole 32. Holes 34 allow expansion and contraction of conductors 12 and 14 relative to each other due to temperature cycling. Connector 15 thus achieves a second function; it becomes a mechanical expansion joint. This eliminates the needs for braid or flex assemblies used on conventional joints.

In use, conductors 12 and 14 are mounted so that they have their ends opposite to each other as shown in FIG. 1. Connector unit 15 is then moved transversely of the conductors and slid onto same in the direction of arrow 36. As this occurs, fins 26 of the various devices 24 carried in grooves 18 of connector unit 15 move into electrical contact with the outer faces of conductors 12 and 14 and, because devices 24 are electrically connected to connector unit 15, conductors 12 and 14 are effectively interconnected electrically.

FIG. 1 shows that grooves 18 extend transversely of the lengths of conductors 12 and 14. They can extend longitudinally of such lengths as shown in FIGS. 8 and 9, wherein an electrically conductive connector unit 50 of transversely U-shaped configuration has a pair of sides 52 provided with grooves 54 of the same cross section as grooves 18 of FIG. 1. Each groove 54 extends between the side face 56 of a respective side 52 and is adapted to receive a louvered connector device 58 of the same construction as that shown in FIG. 5 and used in the embodiment of the connector unit of FIG. 1. A rod or bar 60 extends between sides 52 in spaced relationship to the bight 62 of unit 50 to serve as an alignment guide when unit 50 is moved onto conductors 64 and 66.

In use, connector 50 is placed above the ends of conductors 64 and 66 which are spaced from each other by a gap slightly larger than the diameter of rod 60. Connector unit 15 is then moved downwardly in the direction of arrow 68 and onto the ends of the conductors. In the operative position of FIG. 9, the fins of louvered devices 54 of connector unit 50 engage the latter and conductors 64 and 66 and thereby electrically interconnect the same. Conductor 66 is shown in dashed lines in FIG. 8 and illustrates the electrical contact between the latter and louvered devices 58. Connector 50 represents a bolt-free electrical joint.

Figure 2:
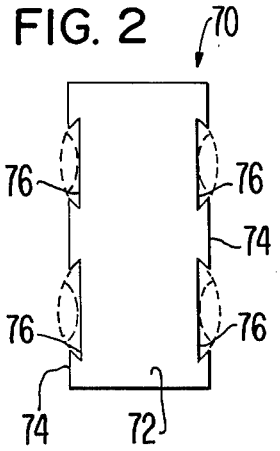
FIG. 2 is a side elevational view of another electrical connector having side grooves for receiving louvered devices.
Figure 3:
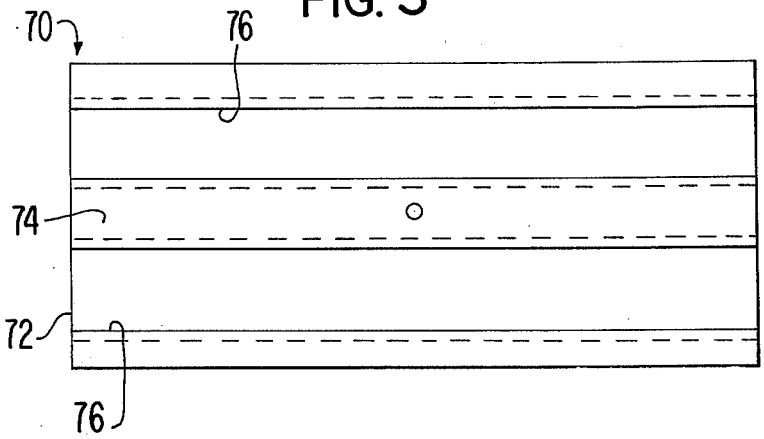
FIG. 3 is a side elevational view of the unit of FIG. 2.

Another embodiment of the connector unit of this invention is shown in FIGS. 2 and 3 and is denoted by the numeral 70. It includes an electrically conductive member 72 of transversely rectangular construction having a pair of opposed sides 74, each provided with a pair of grooves 76 therein running the length of the body as is shown in FIG. 3. The grooves 76 have the same cross section as grooves of FIG. 1*a* and are adapted to receive louvered connector devices of the type shown in FIG. 5. Such louvered devices are shown for purposes of illustration in dashed lines in FIG. 2.

Connector unit 70 can be used in any desired or appropriate application. For instance, it can form one end of a conductor, such as conductor 12 of FIG. 1, so that connector unit 15 need not be provided with grooves and louvered devices 24.

Figure 4:
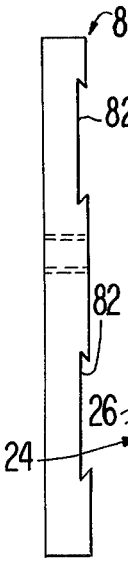
FIGS. 4 and 5 are end and side elevational views, respectively, of a third embodiment of a connector utilizing louvered devices in grooves only on one side of the connector.

Another embodiment of the present invention is shown in FIGS. 4–7. In FIGS. 4 and 5, an electrically conductive plate or body 80 has a pair of spaced grooves 82 only in one face thereof. Louvered connector devices 24 are receivable within grooves 82. Similarly, an electrically conductive connector plate or body 84 (FIGS. 6 and 7) has grooves 86 in one face thereof and plates 80 and 84 are adapted to be placed in back-to-back relationship with the grooves facing outwardly as shown in FIG. 2. Moreover, the plates 80 and 84 can be electrically isolated from each other by placing a strip of insulating material therebetween when the same are interconnected in back-to-back relationship. When plates 80 and 84 are to be interconnected, they are provided with holes 87 and 88, respectively, for receiving bolts or other fasteners, holes 88 being countersunk (FIG. 7) to receive a flat head fastener.

Plates 80 and 84 can be assembled with grooves 82 and 86 facing each other. In this case, a spacer will be used to separate plates 80 and 84 and the spacer thickness will be slightly greater than the thickness of the conductor to be placed between the plates and be electrically contacted by the louvered devices thereof.

A plurality of plates 80 nd 84 can be coupled together in a stack in an arrangement such that a group of aligned conductors which are spaced apart can be placed in bridging relationship to other, respective conductors by the stack of connector plates 80 and 84 having louvered devices 24 in the grooves 82 and 86 thereof, respectively. The fins of devices 24 carried by plates 80 and 84 will electrically contact and thereby electrically interconnect respective conductors.

Another connector assembly of this invention is broadly denoted by the numeral 90 and is shown in FIG. 10. It includes a plurality of electrically conductive bridging connector plates 92 which span the distance between and electrically interconnect the ends of conductors 94 with the ends of corresponding conductors 96 spaced therefrom. The assembly is interconnected by fasteners 98, such as clamps or other structure which allows sliding movement between plates 92 and conductors 94 and 96 due to temperature cycling. Plates 92 and conductors 94 and 96 are of sufficient size and thickness as shown in FIGS. 10 and 10*a* so that they are essentially rigid.

Each plate 92 is provided with a number of grooves 100 on each side face 102 thereof (FIG. 10*a*), the grooves having the same cross section as those described above. Each groove is adapted to receive a louvered connector device 104 of the same construction as device 24 of FIG. 5. FIG. 10 shows conductors 94 and 96 in substantial abutting relationship to the corresponding ends of plates 92.

The presence of louvered devices 24 requires much less clamping pressure than conventional bus joints. It is thus possible to eliminate the relatively large number of bolts and nuts of conventional joints and the corresponding holes in the buses which reduce the effective cross section of the buses. In their place, small clamps can be used. Due to the low pressure required, small relative movements between plates 92 and conductors 94 and 96 can be accommodated.

FIGS. 10 and 10*a* illustrate the way in which a relatively large number of conductors which are normally spaced apart can be effectively electrically interconnected to assure maximum current transfer between the conductors. Plates 92 can be of any suitable or desired length and the device can have grooves as shown in FIG. 10*a* but can also can have grooves which are transverse to FIG. 10*a*. Moreover, the plates can have louvered devices only in one face thereof if desired and can be electrically insulated from one adjacent conductor while being electrically connected through its louvered devices to a second adjacent conductor. Eight combinations of plates and conductors can be utilized, the essential feature being that a plurality of plates with louvered devices can be arranged or assembled in a stack bridging the gap between and for electrically interconnecting spaced conductors in a number of different configurations.

While FIG. 10 illustrates that fasteners 98 rather rigidly interconnect plates 92 with conductors 94 and 96, it is clear that this arrangement need not be limiting. For instance, the plates 92 can be releasably coupled to one set of conductors while being permanently or otherwise fastened to the other set of conductors. This is illustrated in FIGS. 11 and 12 which shows a knife switch formed by assembly 110 with plates 112 having louvered connector devices 114 in both faces thereof. Plates 112 are adapted to electrically interconnect respective conductors 116 and 118 which are normally spaced apart, plates 112 being pivotally mounted as a group on the group of conductors 116 for pivotal movement about an axis 120 extending through a fastener, such as a bolt 122. Insulators 119 are used to separate conductors 116, and insulators 121 are used to separate conductors 118.

The pivotal movement is in the direction of curved arrow 124 (FIG. 12). To pivot the stack of plates 112 relative to conductors 116 and 118, an eyelet 126 is pulled or pushed depending upon the desired direction of movement of plates 112. Eyelet 126 is secured to a bar 128 coupled to plates 112 and at its ends to outer plates 130 which retain the outermost conductors 118 against outward movement due to the bias forces of the louvered devices in grooves thereof to be described.

Each plate 112 is shown in FIG. 12 to have a plurality of grooves 132 extending to the opposed end edges 134 thereof. These grooves have the same cross section as those mentioned above. Louvered connector devices 114 are inserted into the grooves and have fins which project outwardly from the planes of plates 112 for engaging respective conductors 116 and 118. Grooves 132 could, if desired, extend to side edges 136 instead of end edges 134. Grooves 132 are on both sides of plate 112. Thus, FIG. 11 shows a switch which can be mounted in line with the bus and does not require stand-off insulators. It is also an expansion joint in the closed or open position to eliminate the need for flex assemblies as required in conventional switch-to-bus assemblies.

The present invention, in all of its embodiments, relates to a stack of electrically conducting plates having grooves provided with louvered connector devices therein so that the plates and devices can electrically interconnect or isolate a number of conductors in a manner not attainable with conventional connector assemblies.

I claim:

1. An electrical connector assembly comprising: a first rigid electrical conductor means and a second rigid electrical conductor means spaced from said first conductor means; an electrical connector unit having a number of rigid, electrically conducting plates; means mounting the plates of said connector unit in an operative position with said plates being spaced apart and in bridging relationship to said first conductor means and said second conductor means to electrically interconnect said first conductor means and said second conductor means, at least one of the conductor means being movable relative to the plates of said connector unit when the latter is in said operative position to compensate for temperature cycling, each plate having a pair of opposed, outer faces with at least one face provided with a pair of spaced grooves therein aligned with a corresponding conductor means when the connector unit is in said operative position; and a louvered electrical connector device for each groove, respectively, each device being disposed within the corresponding groove and having a plurality of spaced, angled, resiliently mounted fins with each fin having a pair of opposed, outer curved edges in engagement with the adjacent plate and conductor means, respectively, when the connector unit is in said operative position whereby the first conductor means and the second conductor means are electrically connected to each other through the devices and said plates of said unit.

2. An assembly as set forth in claim 1, wherein the grooves in each plate extend longitudinally of the corresponding conductor means.

3. An assembly as set forth in claim 1, wherein the grooves in each plate extend transversely of the corresponding conductor means.

4. An assembly as set forth in claim 1, wherein each plate has a pair of opposed, flat side faces, and a pair of opposed ends, each face of each plate having a number of grooves in each end thereof, respectively, with each groove having one of said devices therein, said mounting means including structure coupling the stack of plates to the first conductor means with the plates having lengths sufficient to bridge the gap between the first conductor means and the second conductor means and with the ends of the plates being proximal to and overlapping respective conductor means.

5. An assembly as set forth in claim 4, wherein said structure includes a pivot pin permitting the plates of said unit to pivot relative to one of said conductor means into and out of connection with the other conductor means, thereby forming a switch.

6. An assembly as set forth in claim 4, wherein said structure includes a clamp.

7. An electrical connector unit for first and second groups of elongated, rigid electrical conductors with a conductor of one group being longitudinally aligned with and spaced from a respective conductor of the other group, said unit including at least a number of rigid electrically conducting plates with each plate having a face provided with a pair of spaced grooves and with each groove aligned with a corresponding conductor; a louvered electrical connector device for each groove, respectively, each device being disposed within the corresponding groove and having a plurality of spaced, angled, resiliently mounted fins with each fin having a pair of opposed, outer curved edges in engagement with the adjacent plate and adapted to engage the corresponding conductor when the unit is in an operative position with said plates bridging the distance between respective conductors of said first and second groups, whereby the conductors are electrically connected to each other through the devices and said plates; and means coupled to the plates for mounting the same in spaced relationship for attachment on at least one group of conductors with the plates having lengths sufficient to bridge the gap between the first and second groups of conductors and with the ends of the plates being proximal to and overlapping respective groups of conductors, the plates of said unit being shiftable relative to the conductors of at least one of the groups when the unit is in said operative position to compensate for temperature cycling.

8. An assembly as set forth in claim 7, wherein the grooves in each plate extend longitudinally of the corresponding conductor means.

9. An assembly as set forth in claim 7, wherein the grooves in each plate extend transversely of the corresponding conductors.

10. An assembly as set forth in claim 1, wherein each plate has a pair of opposed, flat faces and a pair of opposed ends, each face of each plate having a number of grooves in each end thereof, respectively, with each groove having one of said devices therein.

11. An assembly as set forth in claim 7, wherein said mounting means includes a pivot pin to permit the plates of said unit to pivot relative to one group of conductors into and out of connection with the other group of conductors.

12. An assembly as set forth in claim 7, wherein said mounting means includes a clamp.

* * * * *